US006311109B1

(12) United States Patent
Hawthorne et al.

(10) Patent No.: US 6,311,109 B1
(45) Date of Patent: Oct. 30, 2001

(54) METHOD OF DETERMINING TRAIN AND TRACK CHARACTERISTICS USING NAVIGATIONAL DATA

(75) Inventors: Michael J. Hawthorne, Watertown, NY (US); Stephen K. Nickles, Burleson, TX (US)

(73) Assignee: New York Air Brake Corporation, Watertown, NY (US)

( * ) Notice: Subject to any disclaimer, the term of this patent is extended or adjusted under 35 U.S.C. 154(b) by 0 days.

(21) Appl. No.: 09/624,049

(22) Filed: Jul. 24, 2000

(51) Int. Cl.[7] ..... G06F 17/00; G06F 7/00

(52) U.S. Cl. ..... 701/19; 342/450; 342/357.01; 342/357.06; 246/122 R; 246/167 R; 246/169 R

(58) Field of Search ..... 701/19, 28, 70; 340/933, 988, 989, 990, 991, 992, 993; 342/450, 454, 455, 457, 357.01, 357.06; 246/122 R, 167 R, 169 R

(56) References Cited

U.S. PATENT DOCUMENTS

| | | |
|---|---|---|
| 4,638,438 | 1/1987 | Endo et al. . |
| 4,807,127 | 2/1989 | Tenmoku et al. . |
| 4,863,123 | 9/1989 | Bernard et al. . |
| 5,129,605 | 7/1992 | Burns et al. . |
| 5,334,986 | 8/1994 | Fernhout . |
| 5,374,933 | 12/1994 | Kao . |
| 5,394,333 | 2/1995 | Kao . |
| 5,590,856 | 1/1997 | Quinn et al. . |
| 5,740,547 | 4/1998 | Kull et al. . |
| 5,867,122 | 2/1999 | Zahn et al. . |
| 5,902,341 | 5/1999 | Wilson . |
| 5,969,643 | 10/1999 | Curtis . |
| 6,128,558 | 10/2000 | Kernwein . |
| 6,218,961 | 4/2001 | Gross et al. . |

OTHER PUBLICATIONS

Vehicle Positioning—Do you know where your train is?, *Railway Age*, Feb. 1996, pp. 41–42.

*Primary Examiner*—William A. Cuchlinski, Jr.
*Assistant Examiner*—Gertrude Arthur
(74) *Attorney, Agent, or Firm*—Barnes & Thornburg

(57) ABSTRACT

A method using the position data being determined on the train to determine characteristics of the train and/or the track. This is achieved by providing position determining devices at two or more spaced locations along the train. The position of the two locations are determined by the position determining devices. A processor determines the difference between the two locations from the positions determined by the position determining devices and determines the characteristics of the train from the determined difference between the two locations.

34 Claims, 3 Drawing Sheets

METHOD OF DETERMINING TRAIN AND TRACK CHARACTERISTICS USING NAVIGATIONAL DATA

BACKGROUND AND SUMMARY OF THE INVENTION

The present invention relates generally to determining the position of trains on a track and more specifically to determining characteristics of the train and/or track from the position of the train.

With the advent of train control systems, scheduling train systems and train separation, the location of a train on a particular track and its relationship to other trains and track structures is becoming increasingly important. Providing additional intelligence on the train as well as in central locations depend upon the accurate position of a train on a particular track. Global positioning systems (GPS) and other devices have been used to determine the position of the train. Data bases are provided on the locomotive as a point of comparison. Other input devices such as turn rate indicators, compasses, tachometers and odometers also provide additional information used to determine the position of the locomotive. Examples of such systems are illustrated in U.S. Pat. Nos. 5,129,605; 5,740,547; and 5,867,122.

Another system which includes not only determining location but displaying control of a locomotive is described in U.S. patent application Ser. No. 09/151,286 filed Sep. 11, 1998 , now U.S. Pat. No. 6,144,901 which is incorporated herein by reference. This system is directed to the LEADER® System available from New York Air Brake Corporation in Watertown, N.Y.

The present invention makes use of the position data being determined on the train to determine characteristics of the train and/or the track. This is achieved by providing position determining devices at at least two locations along the train. The position of the locations are determined by the position determining devices. A processor determines the difference between the locations from the positions determined by the position determining devices and determines the characteristics of the train from the determined difference between the two locations.

For example, the locations of the position determining devices may be at the head end and rear end of the train. Thus, the differences of the two locations would determine the length of the train. The position is preferably taken when the train is traveling along a flat, straight track. This removes the curvature from the determination as well as any run-in or run-out which would lengthen or shorten the train if it is not flat.

The number of vehicles in the train are also determined and used to estimate the length of the train. The estimated length of the train is compared to the length of the train determined from the position determining devices and any discrepancies are determined. The discrepancies may then be reported. The number of vehicles in the train is determined either from a listing of the vehicles on the train or from the number of axles recorded in a hot box detection system on the train.

A plurality of lengths may be determined and the longest length selected as a length of the train. A plurality of sets of positions can be determined and the change of differences between the positions determined. This change of differences is used to determine a characteristic of the train. This will include run-in and run-out as well as in train forces.

The position determining devices can also determine the elevation of its location. The processor would then derive the grade of the track the train currently occupies from the determined difference of positions and elevations. This provides one track profile characteristic. The heading of each of the position determining devices will be used to derive a track profile.

Track structure information as a function of position and time is also provided to the processor. The track structure is entered at one of the positions of the position determining devices. This is correlated with the other information to provide additional information of the track profile. Track structures may be manually introduced while the other data from the position determining devices are automatically collected. Track structures include one or more of mile posts, bridges, tunnels, signals, crossings, overpasses, underpasses, sidings, parallel tracks and whistle posts. The distance traveled along a track as a function of time is also used to derive the track profile.

The collecting of the data and the deriving of the track profile is performed as the vehicle travels the track. Thus, this not only provides information of the characteristics of the train, it also provides a track profile. If the track profile already exists, this verifies, updates or corrects the pre-existing track profile in the processor. Also, using two or more positions determined by the position determining devices and correlating them to a track profile data base stored on the train, a more accurate determination of the location of the train on the track would result. Additional positioning locating devices may be provided along the train and provide position information to the processor. Preferably, the position determining devices are Global Positioning Systems.

Discrepancies can also be determined in the train as the train rolls across the track. This method includes storing a list on the train of the vehicles in the train. A report from the hot box detection system positioned along the track is stored on the train. The report includes the number of axles of the train monitored by the detection system. The list of cars is compared to the report for the number of axles to determine discrepancies. Any discrepancies are reported. The discrepancies would indicate that the stored list is inaccurate or the hot box detection system is faulty.

Other objects, advantages and novel features of the present invention will become apparent from the following detailed description of the invention when considered in conjunction with the accompanying drawings.

DETAILED DESCRIPTION OF THE PREFERRED EMBODIMENTS

Figures 1A, 1B, 1C:
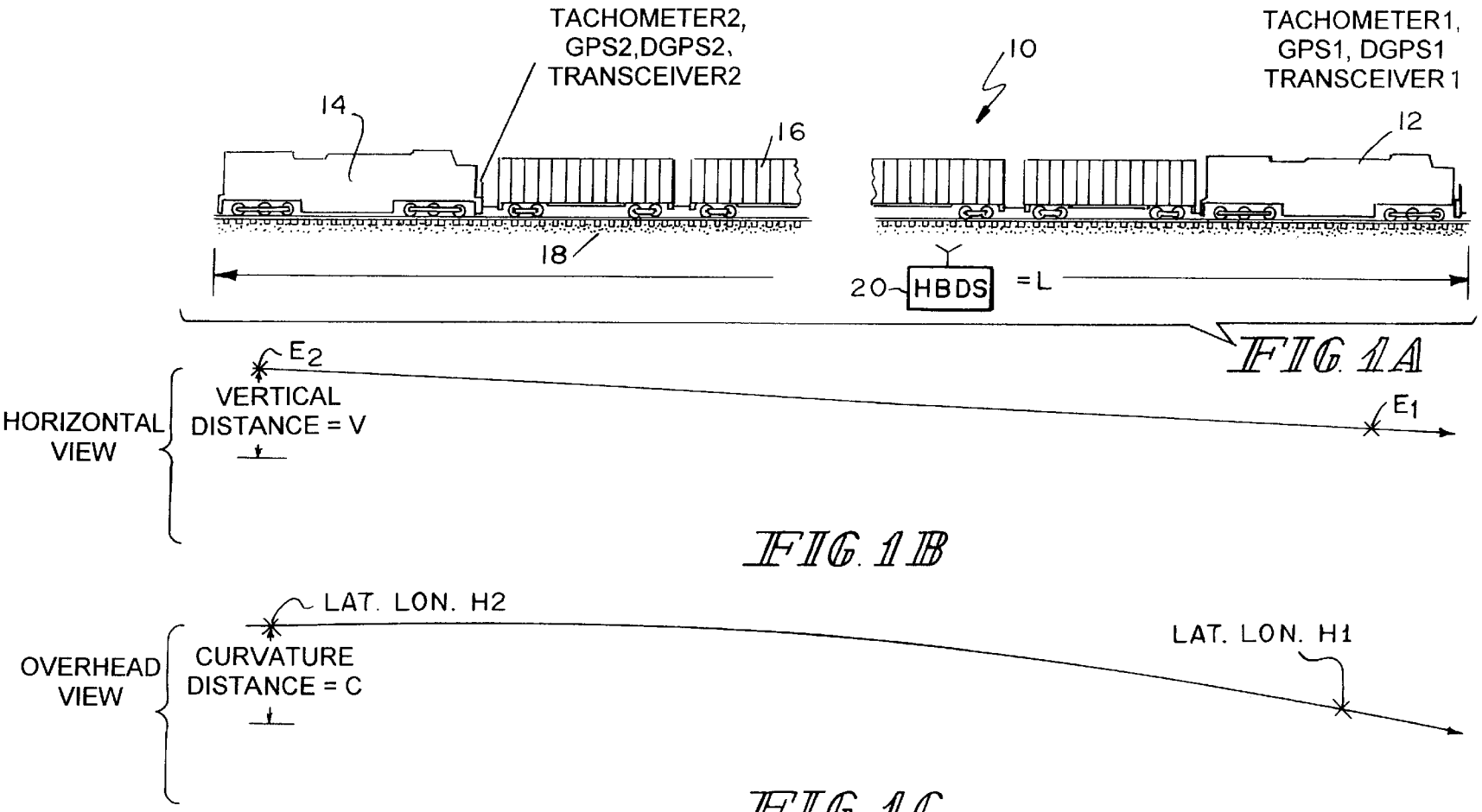
FIG. 1A is a horizontal view of a train on a flat track incorporating the principles of the present invention.
FIG. 1B is a horizontal view of a track having a grade G.
FIG. 1C is an overhead view of a track having a curvature C.

A train 10 shown in FIG. 1A includes a lead locomotive 12, a trailing locomotive 14 and a plurality of cars 16 therebetween. Additional locomotives may be placed intermediate the train or at the front or trailing end of the train.

The train 10 rides on tracks 18. The head locomotive 12 includes a tachometer or any other device to measure distance travel, a navigational receiver shown as a GPS and a differential GPS, and a transceiver. These have become standard equipment on locomotives to determine their position. At least one other navigational receiver is provided in another point of the train. Preferably, as illustrated, the navigational receiver, including a GPS and a differential GPS as well as a transceiver, are placed at the end of train locomotive 14. An additional tachometer may be provided.

Although a pair of navigational receivers or position determining devices and are shown and will be used in the following examples, a plurality of position determining devices with appropriate transceivers may be provided at multiple locations along the train. With additional position determining devices or navigational receivers, the accuracy of the train and track characteristic to be determined or derived is increased. It should be noted that transceivers provided at the position determining devices are radio transceivers communicating with each other. There may also be transceivers on a wire running through the train. If the train is not completely wired, a radio or other form of wireless transmission will be required.

Various characteristics of the train and the track may be determined or derived using the spaced position determining devices. For example, the length of the train may be determined from the difference of the longitude and latitude of the position determining devices in the locomotives 12 and 14. To determine the true length of the train using the longitude and latitude received from the navigational receivers, the train should be on a straight track and also should be on a level track. If it is not on a straight track or a level track, the longitude and latitude information will not provide a true length of the train. The methods of determining the grade the track and the locomotive as well as the curvature will be described with respect to FIGS. 1B and 1C. This would be one method of determining whether the train is on a straight level track.

Another method would be taking a plurality of readings and determining the differences of the positions and using the longest length as the length of the train. Also, by monitoring the length of the train at different times, and the differences of the length, it could be determined whether the train is experiencing run-in or run-out occupying a curve as well as determining in-train forces.

The accuracy of the length of the train determined from the positioning determining devices can be measured by comparison with the number of cars in the train. By using the number of cars in the train, an estimate of the length can be produced and compared against the length determined by the position determining devices. Any discrepancies can be reported. This would indicate that there is an error either in the supposed number of cars in the train or the length determined by the position determining devices.

The number of vehicles in the train can be determined from a listing of the consist of the vehicles in the train. This could include the number of vehicles, the type of vehicles and the length of the vehicles. An alternate source for this information would be a hot box detection system. As illustrated in FIG. 1, the hot box detection system 20 is located adjacent to the tracks. The detector counts axles as they travel pass the sensor and note whether the thermal signature or any axis is beyond the normal limits. The condition of each axle is radio transmitted to the locomotives 12, 14. From the report of the hot box detection system, the number of axles in the train can be determined. Knowing the number of axles, the number of cars can be determined and again, this can be used to estimate the length of the train.

Figure 3:
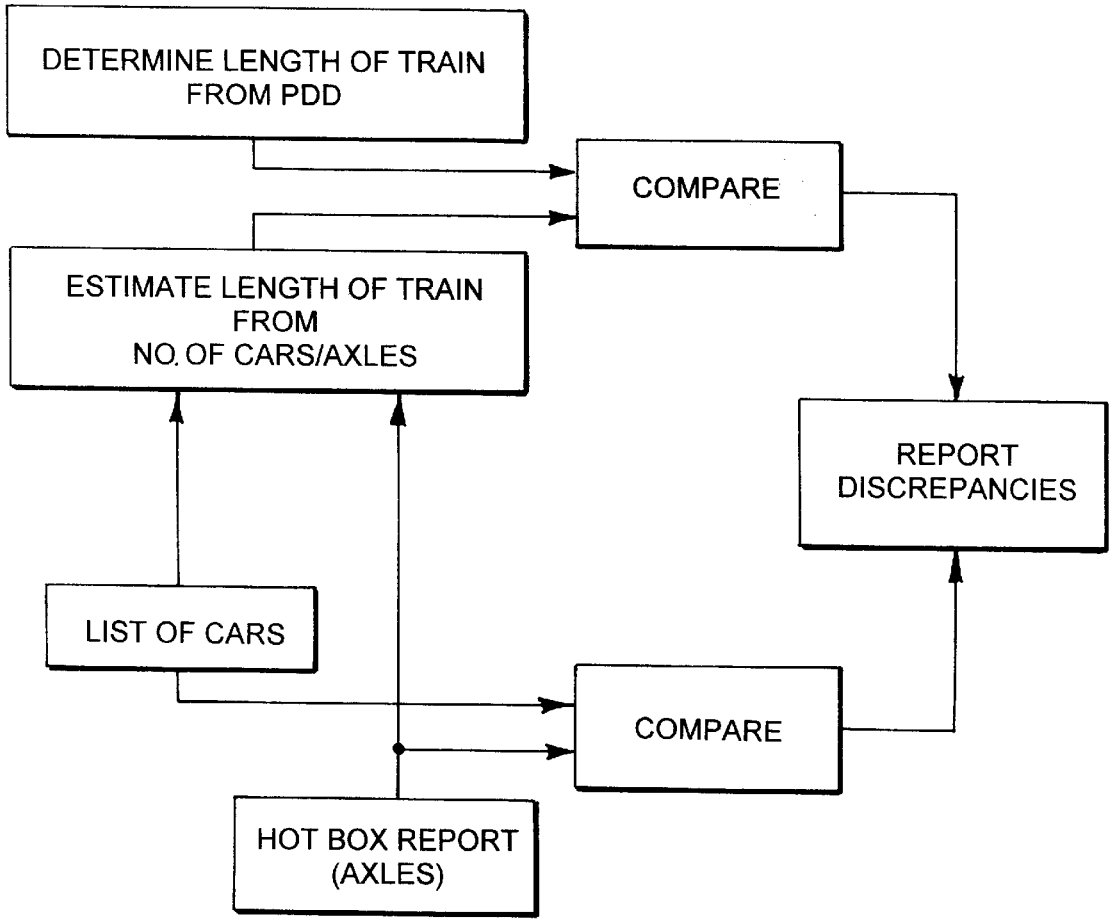
FIG. 3 is a flow chart for a method of determining discrepancies according to the principles of the present invention.

It should also be noted that discrepancies in the train can be determined by comparing the number of cars in the consist list on the train with the information based on the number of axles in the hot box detection system. Any discrepancies in the list of the report will be determined and reported. This will provide an indication that either the list of the consist is inaccurate or that the hot box detection system report is inaccurate. Flow charts for both of these are illustrated in FIG. 3.

A method of determining the grade of the train and consequently the track using the two displaced navigational receivers is also determined using the elevation or altitude of the two navigational receivers. The elevation is generally the distance above sea level. The difference between elevation E1 and E2 in FIG. 1B is their vertical distance. The vertical distance V divided by the length L times 100% yields the grade of the track occupied by the train. Again, to increase the accuracy of this information, the train should be on a straight and not a curved portion of the track. The information of the grade can be used to create a data base of the track and/or to upgrade an existing data base of the track profile.

The curvature information can be used to increase grade calculations by adjusting for the loss of the length due to curves.

The curvature of the track can be determined as illustrated in FIG. 1C by receiving the latitude and longitude and heading from the two displaced navigational receivers. The difference in their position transverse to the center line of the track divided by the length L times 100% equals the curvature C of the track. As with the grade of the track, this information can be used to derive the characteristic of the track to create the data base for the track profile or to update the track profile in a data base. The grade information can be used to increase the curvature calculations by adjusting for change of the length due to the inclination.

The information from the navigational receivers along with a tachometer are stored as a function of time and position automatically while the train 10 traverses the track 18. This information can then be analyzed or processed onboard the train for instantaneous update and storing as well as display to the engineer.

Figure 2:
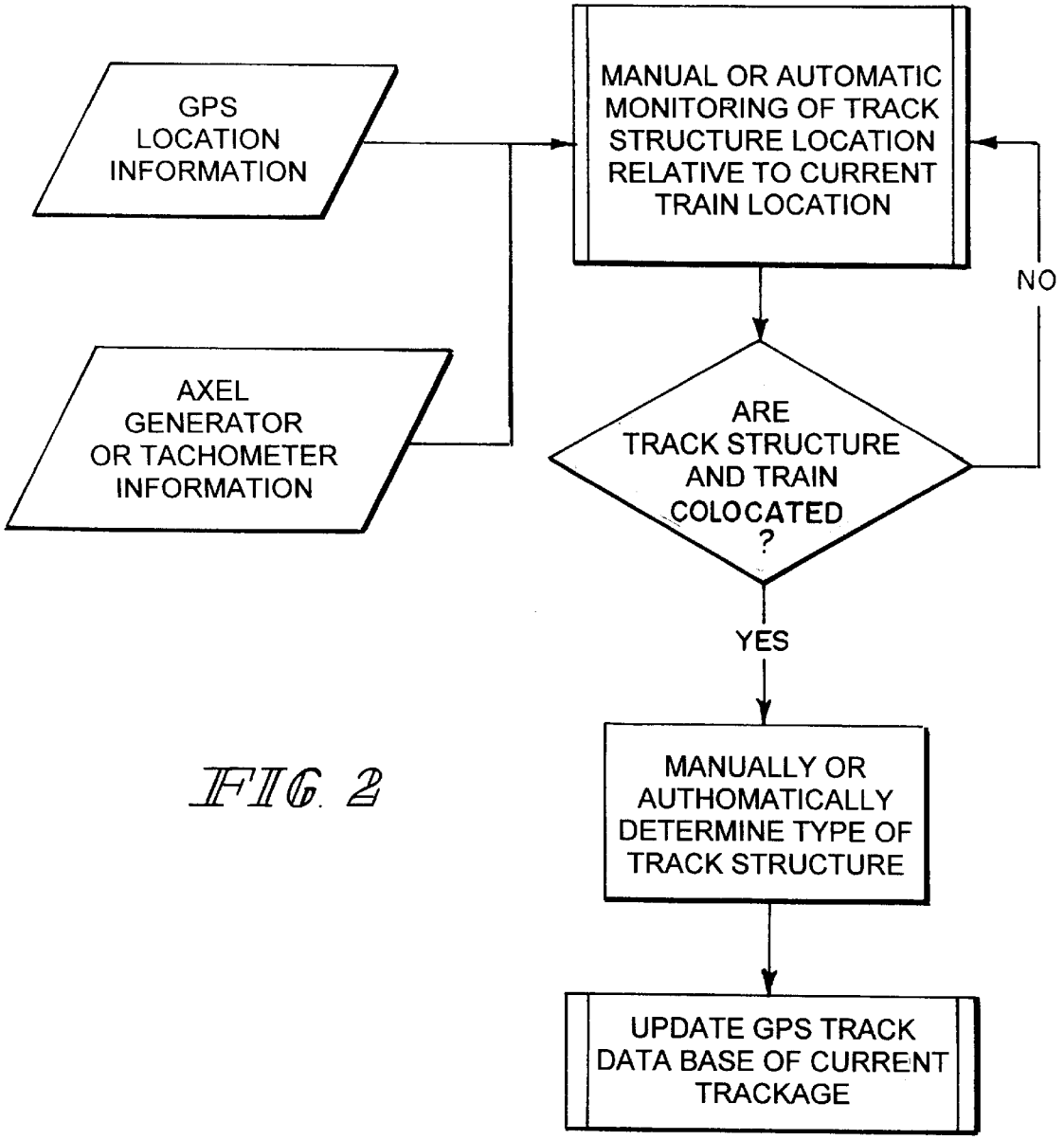
FIG. 2 illustrates a flow chart for a method of deriving or updating track profile according to the principles of the present invention.

Track structure and other information about the track may also be collected as the train 10 traverses the track 18. As illustrated in FIG. 2, the GPS information as well as the information of the distance travel from the axle generator or tachometer information are collected as a function of position or time and correlated with structures relative the current location. If there are track structures which are of interest and that are to be correlated with the train location, they are manually or automatically determined and inputted. This information includes one or more mile posts, bridges, tunnels, signals, crossings, overpasses, underpasses, sidings, parallel track and whistle stops. The manual entry would be by the engineer in the lead locomotive 12. There may also be someone in the trail locomotive 14. If the particular track structure has a transponder, the train can automatically correlate the information with the position as it passes by and receives the signal from the transponder.

As previously mentioned, more than two navigational receivers or GPS systems may be provided throughout the train. If such information is provided, then multiple segments can be measured which would indicate the length of that segment as well as whether that segment is in run-in or run-out and also to be used as reflection of in-train forces for that segment. Also, it will provide a more accurate determination of the elevation or curvature for that segment between a pair of navigational receivers or position determining devices.

It should also be noted that knowing the position of at least two points of the train, a more accurate determination of where the train is on the track may be determined by comparison with prestored data bases. This position can be displayed or used with the previously mentioned systems of the prior art.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A method of determining characteristics of a train having rail vehicles traveling along a track, the method comprising:

providing a position determining device at a head end and a rear end of the train;

determining the positions of the locations using the position determining devices;

determining the difference between the locations from the positions determined by the position determining devices; and determining the length of the train from the determined difference between the two locations.

2. A method according to claim 1, wherein the position is determined when the train is traveling along a flat straight track.

3. A method according to claim 1, including repeating the determining steps a plurality of times to determine lengths of the train and selecting the largest determined length as the length of the train.

4. A method according to claim 1, including determining the number of vehicles in the train, determining a estimate of length using the number of vehicles and determining any discrepancy between the determined and estimated lengths.

5. A method according to claim 4, wherein the number of vehicles is determined from a listing of on the train.

6. A method according to claim 4, wherein the number of vehicles is determined from the number of axles recorded in a hot box detection system on the train.

7. A method according to claim 1, wherein the position determining devices are global positioning systems.

8. A system on a train having rail vehicles for determining characteristics of the train as it traveling along a track, the system comprising:

position determining device at a head end and a rear end of the train; and a processor on the train receiving position data from each of the position determining device, determining the difference between the locations from the data and determining the length of the train from the determined difference between the locations.

9. A system according to claim 8, wherein the position is determined when the train is traveling along a flat straight track.

10. A system according to claim 8, wherein the processor determines a plurality of lengths of the train and selects the largest determined length as the length of the train.

11. A system according to claim 8, wherein the position determining devices are global positioning systems.

12. A system according to claim 8, including position determining device at more than two locations along the train and providing position data to the processor.

13. A system according to claim 8, including a transceiver at each position determining device.

14. A method of determining characteristics of a train having rail vehicles traveling along a track, the method comprising:

providing a position determining device at at least two locations along the train;

determining the positions of the locations using the position determining devices;

determining the difference between the locations from the positions determined by the position determining devices; and repeating the position and distance determining steps a plurality of times;

determining the changes of the differences; and determining the characteristic of the train from the difference changes of distance between the two locations.

15. A method according to claim 14, wherein the characteristic determined is run-in and run-out.

16. A method according to claim 14, wherein the characteristic determined is in-train forces.

17. A method of determining location of a train having rail vehicles on a track, the method comprising:

providing a position determining device at two locations along the train and a track profile data base on the train;

simultaneously determining the positions of the two locations using the position determining devices;

comparing the positions determined by the position determining devices to the data base; and determining the location of the train on the track from the comparison.

18. A method of determining discrepancies in a train having rail vehicles traveling along a track comprising:

storing a consist list on the train of the vehicles in the train;

storing a report on the train from a hot box detector system positioned along the track, the report including the number of axles of the train monitored by the detector system;

comparing the list to the report for the number of cars or axles for discrepancies; and reporting any discrepancies.

19. A method of determining grade of a track as train having rail vehicles travels along the track, the method comprising:

providing a position determining device at at least two locations along the train;

determining the positions and the elevation of the locations using the position determining devices;

determining the differences of positions and elevations determined by the position determining devices; and determining the grade of the track occupied by the train from determined differences of positions and elevations.

20. A system on a train having rail vehicles for determining grade of track as the train travels along the track, the system comprising:

position determining device at at least two locations along the train; and a processor on the train receiving position an elevation data from each of the position determining device, determining the difference between the locations from the data, and determining the grade of the track occupied by the train from determined differences of positions and elevations.

21. A method of deriving a track profile as a train having rail vehicles travels along the track, the method comprising:

providing a position determining device at at least two locations along the train;

determining the positions of the locations including longitude, latitude and elevation data as a function of time using the position determining devices;

determining the difference between the locations' longitude, latitude and elevation data as a function of time from the positions determined by the position determining devices; and deriving a track profile using the differences of longitude, latitude and elevation data as a function of time.

22. A method according to claim 21, further including using heading data as a function of time from the position determining devices to derive track curvature.

23. A method according, to claim 21, further including using track structures information as a function of time from at least one of the position determining devices to derive track profile.

24. A method according to claim 23, including manually collecting the track structure information with the automatic collecting of the other data.

25. A method according to claim 23, wherein the track structure includes one or more of mileposts, bridges, tunnels, signals, crossings, overpasses, underpasses, siding, parallel track, and whistle posts.

26. A method according to claim 21, further including using distance traveled data along the track as a function of time to derive track profile.

27. A method according to claim 21, including collecting the data on a vehicle as the vehicle travels the track.

28. A method according to claim 27, including deriving the track profile on a vehicle as the vehicle travels the track.

29. A system on a train having rail vehicles for determining characteristics of the train as it traveling along a track, the system comprising:

position determining device at at least two locations along the train; and a processor on the train receiving position data from each of the position determining device, determining the difference between the locations from the data, determining changes of differences between the two locations, and determining a characteristic of the train from the determined changes of differences between the two locations.

30. A system according to claim 29, wherein the characteristic determined is one of run-in and run-out and in-train forces.

31. A system on a train having rail vehicles for determining characteristics of the train as it traveling along a track, the system comprising:

position determining device at at least two locations along the train; and a processor on the train receiving position data including longitude, latitude and elevation data as a function of time from each of the position determining device, determining the difference between the locations' longitude, latitude and elevation data as a function of time, and deriving a track profile using the differences of longitude, latitude and elevation data as a function of time.

32. A system according to claim 31, wherein the processor uses heading data as a function of time from the position determining devices to derive track profile.

33. A system according to claim 31, wherein the processor uses track structures information as a function of time from at least one of the position determining devices to derive track profile.

34. A system according to claim 33, wherein the track structure includes one or more of mileposts, bridges, tunnels, signals, crossings, overpasses, underpasses, siding, parallel track, and whistle posts.

* * * * *